United States Patent [19]

Adams et al.

[11] 4,118,921

[45] Oct. 10, 1978

[54] YARN OF ENTANGLED FIBERS

[75] Inventors: Dustin Stetson Adams; Frederick C. Field, Jr., both of Wilmington, Del.; James Ronald Layton, Goodlettsville, Tenn.

[73] Assignee: E. I. Du Pont de Nemours and Company, Wilmington, Del.

[21] Appl. No.: 844,106

[22] Filed: Oct. 19, 1977

Related U.S. Application Data

[60] Division of Ser. No. 730,023, Oct. 6, 1976, Pat. No. 4,080,778, which is a continuation of Ser. No. 564,217, Apr. 1, 1975, abandoned.

[51] Int. Cl.[2] ..... D02G 3/00; D02G 3/24

[52] U.S. Cl. ..... 57/140 R

[58] Field of Search ..... 57/2, 157 F, 157 R, 57/157 S, 140 R; 19/0.35, 0.46, 0.58

[56] References Cited

U.S. PATENT DOCUMENTS

| | | | |
|---|---|---|---|
| 2,245,191 | 6/1941 | Guenther et al. | 19/0.35 X |
| 2,366,785 | 1/1945 | Hays | 19/0.35 |
| 2,523,854 | 9/1950 | Woods | 57/157 |
| 2,721,440 | 10/1955 | New | 57/2 |
| 2,784,458 | 3/1957 | Preston | 19/0.41 |
| 2,946,181 | 7/1960 | Tissot et al. | 57/157 |
| 3,043,088 | 7/1962 | Breen | 57/157 |
| 3,079,746 | 3/1963 | Field, Jr. | 57/51 |
| 3,110,151 | 11/1963 | Bunting, Jr. et al. | 57/157 |
| 3,487,619 | 1/1970 | Field, Jr. | 57/51 |
| 4,062,177 | 12/1977 | Kojima et al. | 57/2 X |

*Primary Examiner*—Charles Gorenstein

[57] ABSTRACT

A zero twist, staple fiber yarn of good strength, outstanding cleanness and good uniformity is produced from continuous filaments by a direct spinning process followed by entangling to a pin count of less than 50 millimeters. Filaments of less than 70 percent break elongation are stretch broken to fibers having an average length of 18 to 60 centimeters with at least 5 percent short fibers, at least 1.5 percent long fibers, and 50 to 93.5 percent fibers of lengths between 12.7 and 76 centimeters.

4 Claims, 7 Drawing Figures

YARN OF ENTANGLED FIBERS

REFERENCE TO RELATED APPLICATIONS

This is a division of application Ser. No. 730,023, filed Oct. 6, 1976, now issued as U.S. Pat. No. 4,080,778, which was a continuation of application Ser. No. 564,217, filed Apr. 1, 1975, now abandoned.

BACKGROUND OF THE INVENTION

Spun yarns of synthetic staple fibers have been produced by cutting continuous filaments into staple fibers, which are then assembled into yarn in the same manner as fibers of cotton or wool. A simpler direct spinning process is also used wherein parallel continuous filaments are stretch-broken and drafted between input rolls and delivery rolls in a drafting zone to form a sliver of discontinuous fibers which is thereafter twisted to form a spun yarn as disclosed, for example, in New U.S. Pat. No. 2,721,440 or Preston U.S. Pat. No. 2,784,458. A true twisting operation is inherently slow. Higher speeds can be obtained by using a false-twisting device, as disclosed in Tissot et al. U.S. Pat. No. 2,946,181 or Field, Jr. U.S. Pat. No. 3,079,746. Tissot et al. teaches that the use of gelatin size will provide adequate strength for weaving or knitting. However, the yarn lacks strength after the size is removed during fabric finishing. Field, Jr., teaches the use of a twisting jet to produce a yarn having surface fibers wrapped about a core bundle which is substantially free of true twist. However, improvements in this product are desirable to make it even more like a conventional spun yarn.

Bunting, Jr., et al. U.S. Pat. No. 3,110,151 discloses at column 23, lines 33–52, a process in which staple fibers averaging 7.6 centimeters long and 2 denier per filament were fed as a roving to drafting rolls and then through an entangling jet device, referred to therein as an interlacing jet, for entangling into yarn. Such products are not comparable to conventional spun yarns in strength, cleanness (freedom from neps and slubs), and uniformity.

SUMMARY OF THE INVENTION

It has now been found that yarn of satisfactory strength, outstanding cleanness, and good uniformity can be produced by an improvement in the direct spinning process of stretch-breaking and drafting parallel, continuous, synthetic organic filaments.

In the process of the present invention, continuous filaments having a break elongation of less than 70 percent are supplied to the drafting zone, the filaments are stretchbroken with an imposed draft of 5 to 100X with a vertical spacing of 65 to 130 centimeters between the input rolls and the delivery rolls in which the filaments are unsupported while avoiding accumulation of static charges on the filaments to provide discontinuous fibers having a number average fiber length of 18 to 60 cm., and the fibers are removed from the drafting zone over an apertured delivery roll with an aspirating jet. The fibers are entangled by the aspirating jet to form a yarn which may (optionally) be further entangled with an entangling jet.

The invention provides novel, spun-like, entangled, staple-fiber yarn characterized by the presence of both short fibers (of up to 12.7 cm. in length) and very long fibers (having a length greater than 76 cm.). Because the yarns are not compacted by twist, they are somewhat bulkier and provide better cover than ring-spun yarns of the same count. Preferred products of the invention are entangled yarns having a pin count of 3 to 50 mm. and comprising closely adjacent synthetic discontinuous organic fibers randomly intermingled along the length of the yarn to maintain the unity of the yarn by frictional constraint between the fibers, said fibers having a number average fiber length of 18 to 60 cm. and a distribution of fiber lengths such that at least 5% of the fibers are no longer than 12.7 cm., 50 to 93.5% of the fibers are longer than 12.7 cm. and no longer than 76 cm. and at least 1.5% of the fibers are longer than 76 cm. and preferably less than 250 centimeters.

In a preferred embodiment of the invention, the product is an entangled yarn in which the pin count is within the range of 3 to 25 mm. Such yarns have high strength. Preferably the yarn tenacity in grams per denier is at least 45 percent of the filament tenacity.

In a particularly preferred product embodiment of the invention, the synthetic discontinuous organic fibers are polyethylene terephthalate fibers.

DETAILED DESCRIPTION

The products of this invention can be prepared by forming in a feed zone a substantially zero twist ribbon of parallel synthetic organic continuous filaments having an elongation at break of less than 70 percent (preferably no greater than about 40 percent), passing the ribbon to the drafting zone input rolls of a direct spinning machine, passing the ribbon to drafting zone delivery rolls spaced 65 to 130 cm. (preferably about 75 to 100 cm.) vertically below the input rolls and operated at a surface speed 5 to 100 times higher than the input rolls to form a ribbon of discontinuous fibers having the required number average fiber length and distribution of fiber lengths. The ribbon of filaments may be drawn to the desired level of break elongation in the feed zone. At least one of the delivery rolls is apertured so that the air or other gas in the drafting zone carried along by the ribbon is cocurrently flowed in the direction of fiber delivery through the apertures in the roll. From the delivery rolls, the fiber ribbon is sucked through an aspirating jet of compressible fluid to form a lightly entangled yarn of discontinuous fibers. The level of static electricity is maintained at a low level in both the feed zone and the drafting zone. The yarn delivered from the aspirating jet is sometimes referred to herein as an unconsolidated yarn.

In a preferred embodiment of the invention, the unconsolidated yarn is passed from the aspirating jet to an entangling jet to form a more highly entangled yarn, after which the yarn is wound on a package. The yarn delivered from the entangling jet, sometimes referred to herein as a consolidated yarn, usually has a lower pin count than the unconsolidated yarn.

Figures 1, 2:
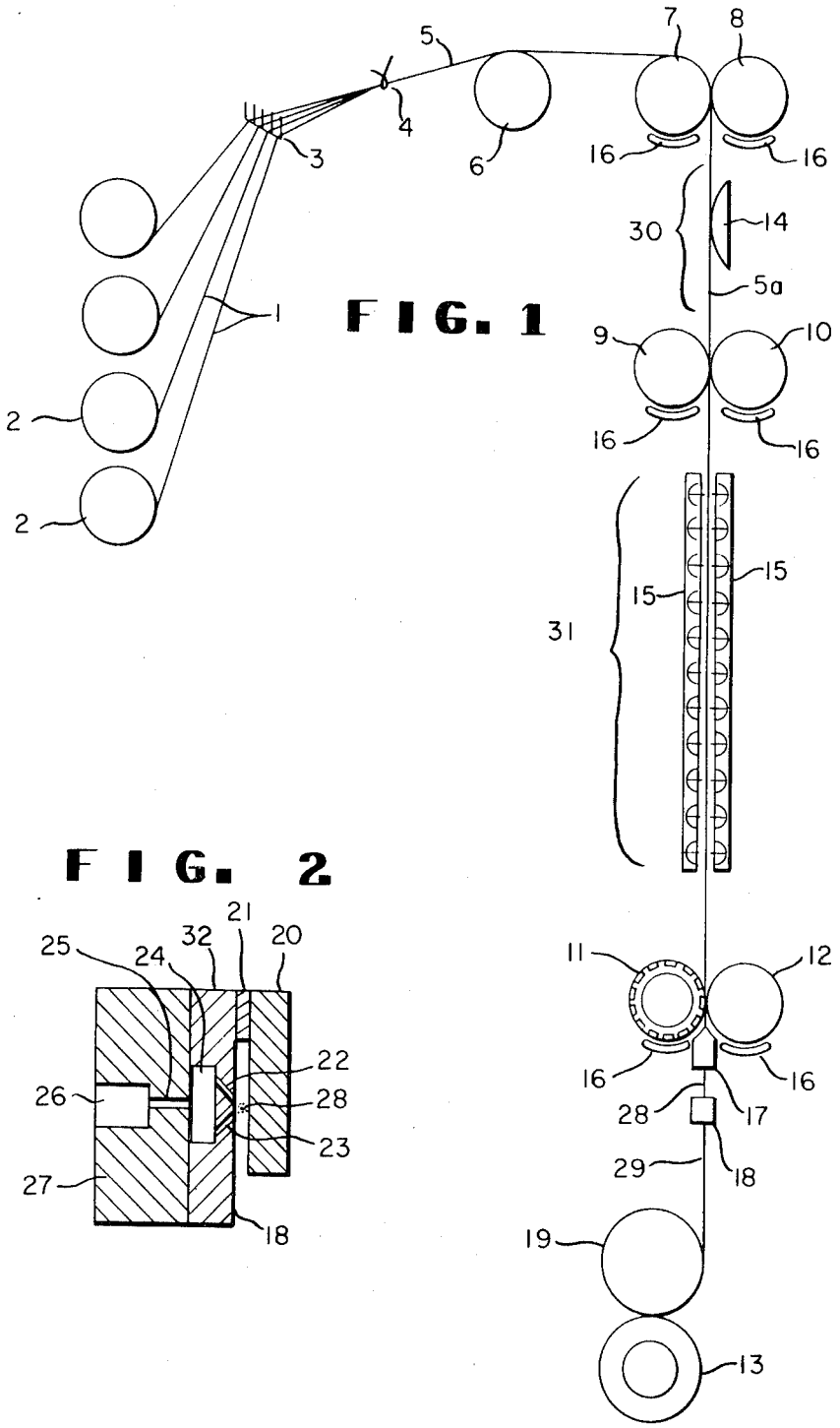
Figure 5:
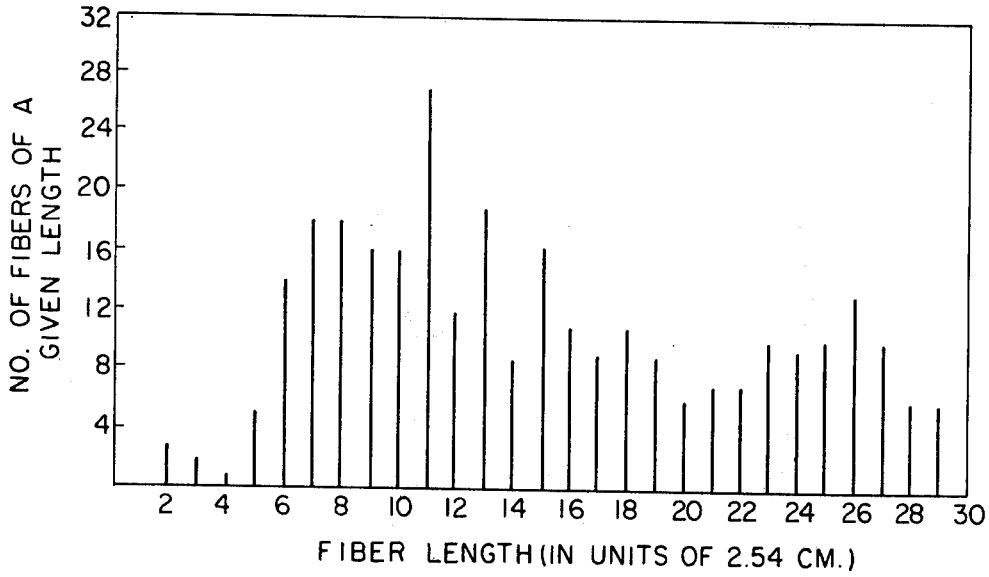
Figure 6:
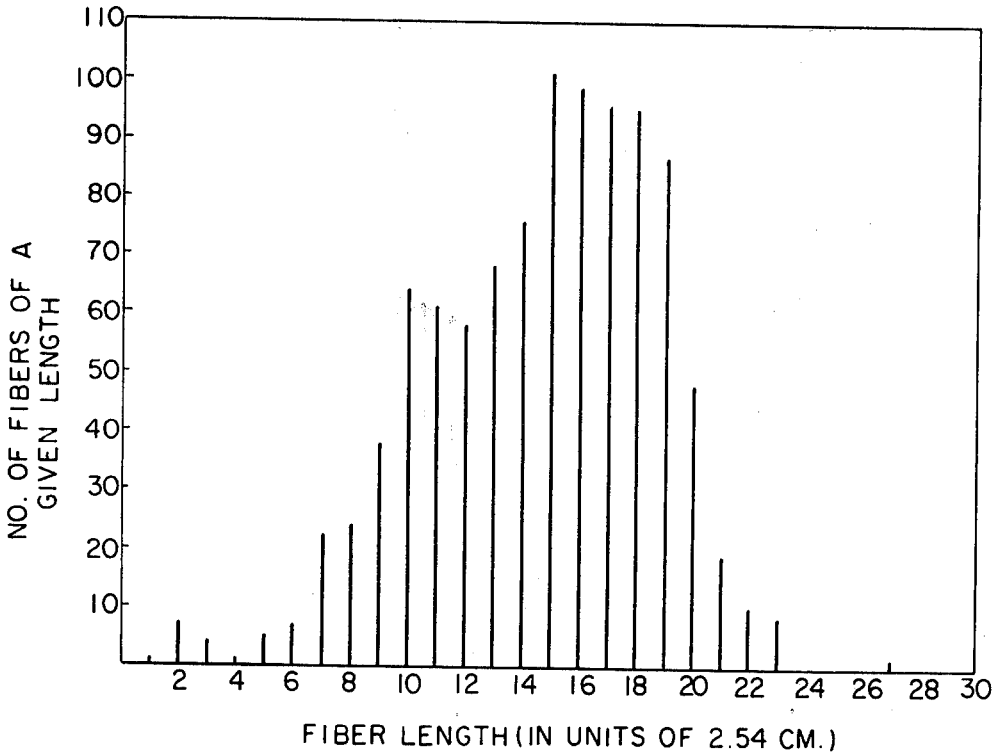
Figure 7:
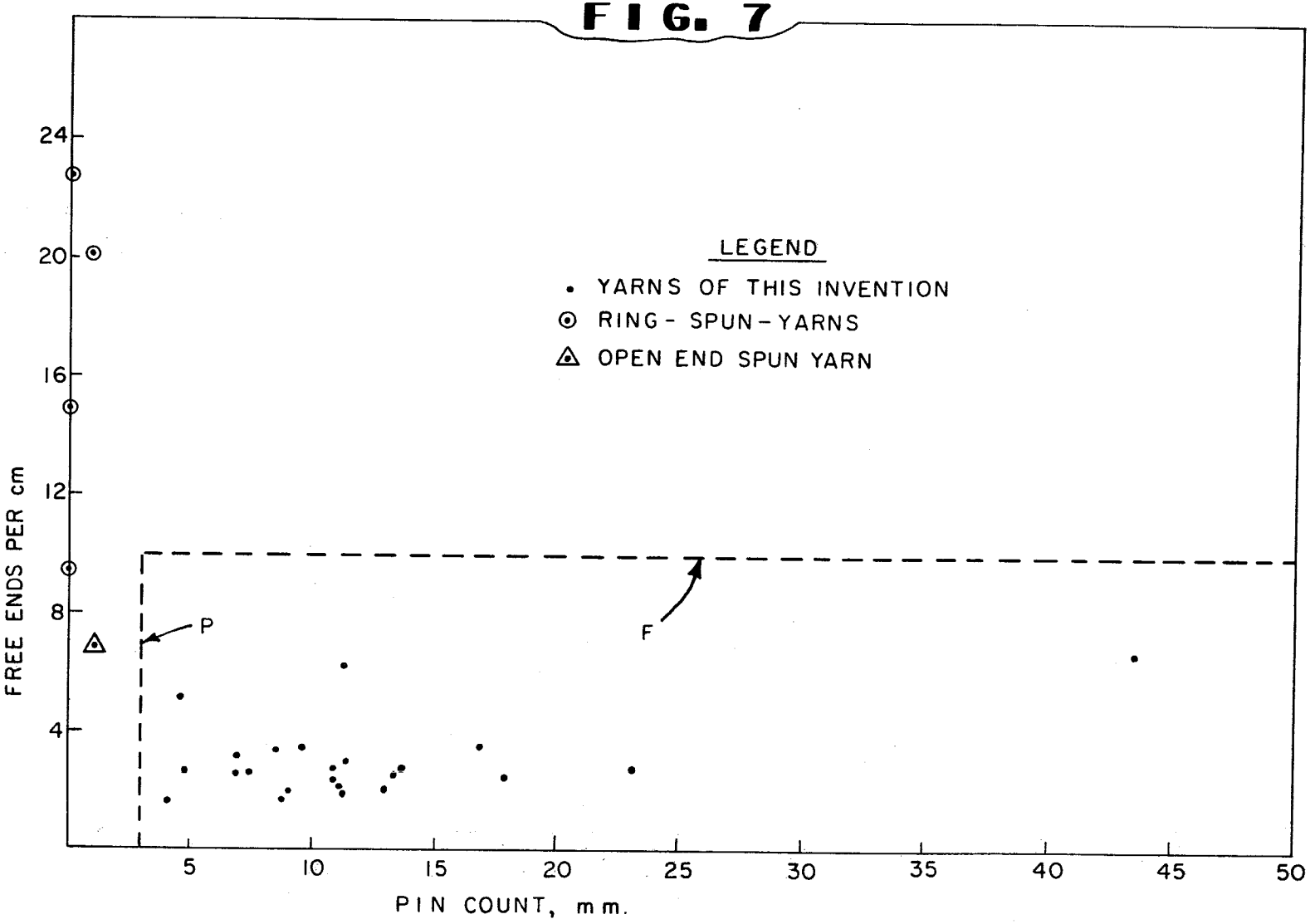

The invention will be better understood by reference to the accompanying drawings, in which FIG. 1 is a side elevation of a form of apparatus for use in the process of the invention, FIG. 2 is an enlarged cross section of the entangling jet shown in FIG. 1, FIGS. 3–6 are histograms of fiber length distributions of yarns prepared in accordance with the examples, and FIG. 7 is a graph illustrating values for pin count and number of free ends per centimeter observed for yarns of this invention in comparison to values for typical ring-spun and open-end-spun yarns.

DESCRIPTION OF DRAWINGS AND MODE OF OPERATION

Referring to FIG. 1, ends 1 of zero-twist yarns of parallel continuous filaments supplied from packages 2 are passed through guides 3 and 4 to form tow 5, which is passed over idler roll 6 and then successively into the nips of feed rolls 7 and 8, the drafting zone input rolls 9 and 10, and the drafting zone delivery rolls 11 and 12, finally being wound on package 13. In this apparatus, the feed zone 30 comprises the space between the nip of rolls 7 and 8 and the nip of rolls 9 and 10, while the drafting zone 31 comprises the space between the nip of rolls 9 and 10 and the nip of rolls 11 and 12. As the tow passes through the nip of the feed rolls, it is converted to a ribbon 5*a* of continuous filaments. The drafting zone input rolls may be operated at a higher surface speed than the feed rolls, so that the ribbon is drawn as it passes from rolls 7 and 8 to rolls 9 and 10; however, the filaments supplied from packages 2 may already be oriented to the desired extent, so that the drawing step is not necessary. The filaments may also be passed in contact with hot shoe 14 while being passed between rolls 7 and 8 and rolls 9 and 10; however, the hot shoe is omitted when it is not desired to heat the filaments.

Rolls 11 and 12 are driven at a surface speed much higher than that of rolls 9 and 10, so that the filaments are broken in random manner while passing between the two sets of rolls. The draft ratio, i.e., the ratio between the surface speeds of the two sets of rolls, is usually in the range of 5X to 100X. Static bars 15 are placed on each side of the ribbon in the drafting zone to minimize static charges on the fibers, thus minimizing splaying. Rolls 7 and 9 are preferably driven metal rolls, while rolls 8 and 10 are preferably rubber rolls. In the delivery zone, roll 12 is also usually a rubber roll, while roll 11 is an apertured roll of the type described by Field in his U.S. Pat. No. 3,438,094, having an internal passageway for air flowing concurrently with the yarn through the nip of the rolls. Porous cloth bags 16 of a powdered antistatic material are desirably placed beneath the feed rolls, input rolls, and delivery rolls. The ribbon of discontinuous fibers passes from the nip of the drafting zone delivery rolls into aspirator 17 and then through entangling jet 18 to form the product, a yarn of entangled discontinuous fibers, which is passed around traversing drive roll 19 and wound up on package 13.

Figure 3:
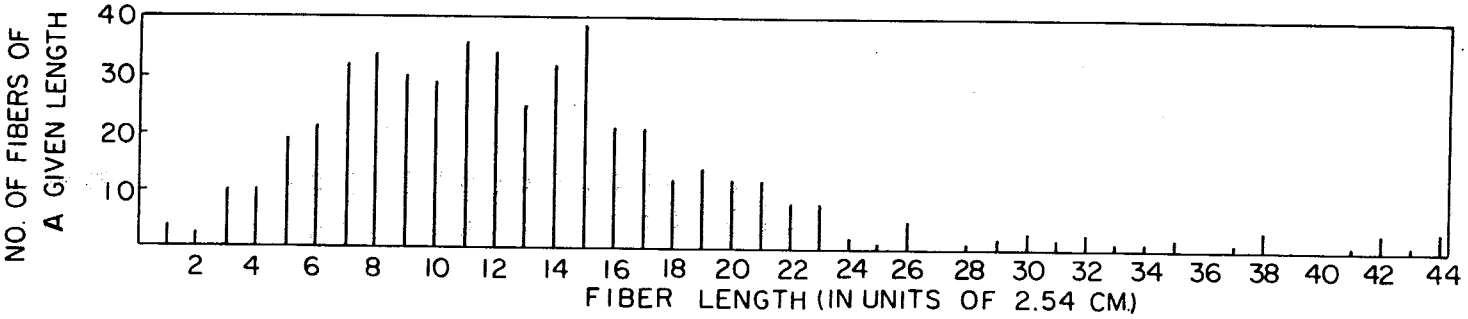

Aspirating jet 17, which has the design generally shown by Field in FIG. 3 of his U.S. Pat. No. 3,079,746, has fins shaped to the contour of rolls 11 and 12 so as to fit snugly between the rolls and extend nearly into the nip. Although the primary function of the aspirating jet is to remove the ribbon of fibers from the nip of the rolls in a manner preventing roll wraps, this jet also acts upon the fibers comprising the ribbon to convert it into an entangled yarn 28, which usually has a rather low level of entanglement. This unconsolidated yarn already has relatively good strength, and if desired it may be wound directly to a package and used for weaving fabrics or for other end uses. It is a slub-free yarn of excellent cleanness.

In a preferred embodiment of the invention, the unconsolidated yarn is forwarded to the entangling jet 18 before packaging. The entangling jet 18, as shown in FIG. 2, comprises air hole plate 32 and parallel backing plate 20, spaced away from the air hole plate by shim 21. Opposed fluid conduits 22 and 23 receive air under pressure from chamber 24, supplied in turn by air supply channels 25 and 26 in adaptor plate 27, upon which the air hole plate is mounted. The vortices created by the jets of air from the opposed fluid conduits randomly entangle the fibers of the yarn 28 passing between the air hole plate and the backing plate, centered between the two conduits. Although the consolidated yarn 29 delivered from the entangling jet is usually more compact than the unconsolidated yarn, the fibers comprising it are still relatively less tightly confined than those comprising conventional ring-spun yarns. The consolidated yarn has excellent strength, generally somewhat higher than the strength of ring-spun yarns, and is a slub-free, outstandingly clean yarn.

It is important that the continuous filaments comprising the ribbon entering the drafting zone have a break elongation of less than 70%. If their elongation is higher, the yarn product lacks the outstanding cleanness, evenness, and high strength of the product of the invention. Break elongations of about 40% or lower are preferred. To obtain the required low break elongation, the ribbon may be drawn in the feed zone, passing the filaments over a hot shoe to facilitate the drawing operation if desired. Of course, the ribbon may be formed from continuous filaments which already have a break elongation of less than 70%. Also, a single supply package of tow containing the desired total number of feed filaments may be used in place of the multiple packages shown in FIG. 1.

Another important feature of the process of the present invention is that the drafting zone input rolls and the drafting zone delivery rolls be spaced far apart. This distance, called the "ratch length", should be in the range of 65 to 130 cm. The continuous filaments are not supported as they pass vertically downward through the ratch between the rolls with an imposed draft of 5–100X, and as they pass through the ratch they break at random intervals. To produce good evenness properties in the yarn product, a draft of at least 5X is generally used, although the process is operable when lower drafts are used. Although there is no fixed upper limit on the draft ratio, machinery restrictions usually impose a practical limit of about 100X.

In accordance with the present invention, it has been found that when the filaments have a break elongation of less than 70% and the ratch length is about 65 to 130 cm., the filaments break in such a way that a considerable proportion (at least 5%) of the resulting staple fibers have a length no longer than 12.7 cm., while a small proportion (at least 1.5%) have lengths greater than 76 cm. Some of the short fibers have lengths ranging down to about 1 cm., while some of the long staple fibers are found to have lengths ranging up to about twice the ratch length. The presence of both the short fibers and the long fibers is necessary for the novel yarn of the invention. When the yarn contains less than about 5% short fibers, the spun character of the yarn is deficient. When the yarn contains less than 1.5% long fibers, it lacks adequate cleanness and strength. Generally about half or more of the fibers in the yarn product are of medium length. The fiber distribution of the yarn is also characterized by a number average fiber length of 18 to 60 cm. When the number average fiber length of the yarn is less than 18 cm., the yarn tends to have low strength; when it is more than 60 cm., the yarn tends to have poor denier evenness.

When the process is carried out with a ratch length of less than about 65 cm., it is difficult to produce a yarn having the desired proportion of long fibers and the cleanness of the resulting yarn is usually poor (high nep count). When a ratch length of more than 130 cm. is used, the proportion of short staple fibers is usually lower than desired, so that the yarn lacks spun-like character. A ratch length of about 75 to 100 cm. is preferred, since the best balance of properties in the yarn product is usually obtained within this range.

Any continuous synthetic filaments of organic polymer, including rayon filaments, are suitable as feed filaments. A variety of such feed filaments is exemplified herein. Blends of different feed filaments can be used. If desired, part of the filaments in such a blend can be subjected to a predrawing operation while the remainder are not.

It is also important to avoid accumulation of static charges on the filaments and fibers in the feed zone and the drafting zone. Such charges arise from friction produced by filaments moving against other filaments and the various surfaces which they contact. To reduce static charges, the filaments can be composed of a synthetic filamentary material having an antistatic composition incorporarted therein, or a conventional antistatic finish compatible with the filaments can be applied. A blend of filaments can also be used in which only a few of the filaments are antistatic filaments. Accumulation of static charges can be avoided by placing static bars adjacent to each face of the ribbon of filaments in both the feed zone and the drafting zone. To further minimize the accumulation of static charges, porous cloth bags containing a powdered antistatic material such as very finely ground calcium carbonate ("commercial whiting") may be placed in contact with each of the rotating rolls which also contact the filaments or fibers. By minimizing static charges on the filaments and fibers, splaying of the bundle or ribbon is also minimized. Use of the apertured roll 11 in the delivery zone is also essential to prevent splaying of the fibers in the ribbon, since this roll provides for the smooth flow of air cocurrently with the yarn through the nip of the rolls.

DESCRIPTIONS OF TESTS

A. Strength and Elongation Tests Lea Product

This is a measure of the comparative breaking load of a 109.7 meter (120 yard) skein of yarn, wound 1.37 meters per turn (1.5 yards per turn), adjusted for the linear density of the yarn; the value being calculated as the product obtained by multiplying the breaking load expressed in units of 454 grams (one pound) of the skein by its cotton count (the number of 1691-meter hanks per kg. or 840-yard hanks per pound). The lea product is a conventional measure of the strength of spun yarns.

Yarn Tenacity

The tenacity, or normalized breaking load, of a yarn is another measure of the breaking strength of the yarn, and is reported as the force in grams/denier necessary to break the yarn. Values reported herein for the yarn product are determined by ASTM Method D-2256, using a tensile testing machine meeting the standards of the method (Table Model Instron, manufactured by the Instron Engineering Corp., Canton, Mass.), modified to provide a 76.2 cm. (30-inch) gauge length to grip the yarn in the testing machine. Tenacity values reported herein are determined with the 76.2 cm. gauge length, except where otherwise specified.

Filament Tenacity and Elongation

The tenacity and breaking elongation of filaments from a continuous filament yarn are determined by the procedure described in ASTM Method D-1380, employing the same tensile testing machine described in the preceding paragraph. In the examples, the elongation values for the filaments fed to the drafting zone include both the extreme values and the average value for all tested samples of a given feed.

B. Yarn Uniformity and Cleanness Yarn Denier Evenness

The evenness, or uniformity of a yarn is determined with the use of a capacitance-type evenness tester. This apparatus gives a measure of the evenness of the yarn in terms of the percent coefficient of variation, CV, which is equivalent to 100 percent times the standard deviation of successive denier determinations divided by the mean. Values reported herein are determined on a Uster evenness tester, Model B, equipped with a quadratic integrator, using the manufacturer's procedure for the measurement. The higher the value of CV, the poorer the yarn evenness. Two measurements are made, corresponding to very short range evenness (corresponding to 0.076 cm. or 0.03 inch cut length) and long range evenness (corresponding to 549 cm. or 216 inch cut length). For meaningful interpretation of evenness values, comparisons should be made between yarns having similar numbers of fibers per cross section, which in turn depends on the yarn size and the denier per filament of the fibers in the yarn.

Cleanness (Nep Count)

As employed herein, the term "cleanness" of a yarn refers to the degree to which the yarn is free of neps, which are small, knot-like aggregates of entangled fibers in a yarn. The nep count of a yarn can be measured simultaneously with the determination for evenness by employing an imperfection attachment on the Uster evenness tester, following the manufacturer's procedure for the measurement. The nep count values reported herein refer to the number of neps in the yarn measured by the machine per 457 meters (500 yards) of yarn. Clean yarns typically have nep count values below about 75.

Neps are undesirable because they cause fabrics made of the yarn to have poor visual appearance and tactile aesthetics; however, they are not large enough to cause mechanical problems, such as causing the yarn to catch on guides. Neps are much smaller than slubs, which are yarn defects in the form of thick, uneven places in the yarn; slubs are characteristically large enough to cause mechanical problems in handling the yarn. The entangled yarns of the present invention are slub-free and have a low nep count.

C. Level of Entangling

The level of entangling in an entangled yarn is determined with the aid of a commercial automatic yarnentanglement tester (Rothschild/Celanese Needle Pull Tester Model R-2040, manufactured by Rothschild Mess Instrumente, Zurich, Switzerland). The equipment is substantially as described in Bulla et al. U.S. Pat. No. 3,566,683, FIG. 7, and Column 5, line 37 through Column 6, line 6. The running tension is determined by the setting of hysteresis brakes 6'. An entanglement is indicated by a rise in tension from the level of the running tension to the predetermined tension sensed by load cell 92. If the piercing needle misses the yarn bundle, the yarn is advanced and such a measurement is automatically rejected. If the yarn being tested contains bundle twist, the yarn should be untwisted to zero twist before measuring the level of entanglement in the yarn. Entanglement pin count values (briefly, "pin count") reported herein, expressed in millimeters, are based on 100 tests averaged together, employing a trip tension of 20 grams and a running tension of 10 grams. The yarn is advanced about 10 cm. (about 4 inches) between measurements with the "transport speed" potentiometer set at "normal" (about mid-scale), the "measuring speed" potentiometer set fully counterclockwise, and the "yarn transport time" potentiometer set fully clockwise.

D. Average Fiber Length and Fiber Length Distribution

If yarn samples are available in both consolidated and unconsolidated forms, the unconsolidated form is usually selected for the following tests for greater facility in carrying out the tests.

Average Fiber Length

Several meters of the yarn to be tested are unwound from the outer layers of the yarn package. A clean cut is made in the yarn near the package, and the length of yarn cut off is discarded. The free end of the yarn remaining on the package is marked with ink, after which approximately one meter of yarn is unwound and laid down lengthwise on a board covered with black velvet, without cutting the yarn from the package. Using a fine-pointed tweezer, one fiber at a time is teased from the yarn bundle, unwinding more yarn when necessary. All fibers marked with ink are removed first and are discarded. After all marked fibers are removed, unmarked fibers are teased carefully from the bundle, the fiber selected for removal always being at the extreme end of the bundle. Whether the fiber to be removed is long or short, it is carefully dissociated from the bundle, working backwards through the yarn until the fiber can be removed without breaking or stretching it or the remaining fibers in the bundle. The length of each fiber removed is measured with a scale graduated in centimeters and millimeters or, if desired, with a scale graduated in inches and eighths of an inch. In making the measurement the length of any fiber not falling exactly in line with a mark on the scale is taken as being equal to the next highest mark on the scale. The results are recorded in centimeters and tenths thereof, converting English units to metric units if necessary. Fibers are taken continuously from the yarn end until at least 100 fibers have been removed. The number average fiber length is calculated as the sum of the lengths of the removed fibers, divided by the number of removed fibers. The weight average fiber length is calculated as the sum of squares of the fiber lengths divided by the sum of the fiber lengths.

Fiber Length Distribution

Measurement of fiber length by the above procedure is continued until at least 500 fibers have been removed and measured. The percentage of short fibers is calculated as the number of fibers having a length equal to or less than 12.7 cm. (5 inches), multiplied by 100% and divided by the total number of fibers measured for length. The percentage of very long fibers is calculated as the number of fibers having a length greater than 76 cm. (30 inches), multiplied by 100% and divided by the total number of fibers measured. The percentage of fibers having a length greater than 12.7 cm. and no more than 76 cm. is calculated as the difference between 100% and the sum of the percentages of short and very long fibers.

Fiber Length Histogram

For Example I and the Comparative Examples, a histogram, or graph illustrating the distribution of fiber lengths, is provided. In these graphs the abscissa comprises the fiber length, measured as described above, in increments of unit length (1, 2, 3, . . . ). The ordinate comprises the number of fibers of a given length, counting any fiber having a length up to 2.54 cm (1 inch) as 1, any fiber having a length greater than 2.54 cm. and up to 5.08 cm. (2 inches) as 2, etc.

E. Yarn Shrinkage

The yarn or ribbon to be tested is cut to provide a sample approximately 50 cm. in length. Knots are tied a short distance from each end, and the knots are marked with a marking pen. A small piece of tape is placed on each end beyond the knot, and a weight is attached to one tape. The yarn sample is placed on a vertical meter stick so that the one knot is opposite a mark on the stick, with the weighted end hanging free. The length of the yarn is then measured, and this reading is taken as the original length. The weight is removed and the yarn sample is coiled and placed in an aluminum pan, taping each end to the bottom of the pan. The pan is placed in an oven at 120° C. for 5 minutes, being careful to place the pan so that air currents do not tangle the sample. The sample is then removed from the pan, the weight is replaced, and the length is measured as before. Three determinations are made and the results are averaged, calculating the shrinkage by multiplying the difference between the original length and the final length by 100% and dividing by the original length.

F. Free End Count

The equipment for carrying out this test includes a jig comprising a rectangular brass plate having (1) a set of locating pins, two on each side of the plate, for positioning an 8.3 cm. × 10.2 cm. (3.25 in. × 4 in.) glass slide and (2) a set of guide pins, five on each of the short sides of the rectangular plate spaced approximately 1.25 cm. apart, for positioning segments of yarn in parallel lines. The rectangle defined by the guide pins is filled by a piece of black velvet to provide a high-contrast background. In carrying out the test, the slide is placed between the locating pins and the yarn to be examined is taped to the upper left-hand corner of the plate, then run successively back and forth across the plate in five parallel lines, using the guide pins to hold the yarn in position, the yarn finally being taped again to the plate at the lower right-hand corner. A second glass slide, taped along each of its short ends with strips of tape approximately 1 cm. wide having adhesive on each face of the tape, is then placed between the locating pins and pressed firmly against the lower slide. This seals the slides together and anchors the yarns. The excess protruding loops around the guide pins are then cut free. The joined slides are then removed from the jig and the short ends are wrapped with masking tape approximately 1 cm. in width to complete the mounting operation. The pair of slides is then placed on a microscope stage at 15X magnification, where the visible free ends in the five yarn segments (each approximately 8 cm. long) are counted. A record of the visible ends in each segment is made on the tape at the right end of that segment. The total number of free ends visible in all of these segments is then obtained by adding the numbers obtained for each of the segments, and the total is divided by the total length of yarn scanned to obtain the average number of free ends per centimeter.

G. Relative Viscosity

Values given in the examples for the relative viscosity (RV) of polyesters are determined by the method described by Piazza et al. in U.S. Pat. No. 3,772,872, Col. 3, lines 57–65.

EXAMPLE I

Polyester continuous filaments having low elongation at break are prepared, stretch-broken to form a ribbon of parallel discontinuous fibers, and entangled, using the process shown in FIG. 1. In carrying out this process, eight ends of 549 denier, 110 filament, zero-twist tow of continuous filaments of polyethylene terephthalate having an RV of 20.7 and spun at 1828 mpm (meters/min.), having a tenacity of 1.82 gram/denier, an elongation of 265%, and containing 0.07% of a finish comprising a mixture of an ethylene oxide condensate of a fatty acid and the amine salt of a phosphate acid ester, are consolidated by a guide and passed into the nip of the feed rolls to form a ribbon of parallel continuous filaments, after which they are passed, without being heated, through the nip of the drafting zone input rolls. The input rolls are driven at 29.3 mpm. surface speed to provide a draw ratio of 2.6X in the feed zone. The feed zone length (distance between the feed rolls and the input rolls) is 25.4 cm. The polyethylene terephthalate filaments in the resulting drawn ribbon have elongations varying from 25 to 52% (averaging 40%), and the shrinkage of the ribbon is 28%.

The ribbon of filaments is fed from the nip of the input rolls through the nip of the drafting zone delivery rolls. The delivery rolls are driven at 284 mpm. surface speed to provide a draft ratio of 9.7X, i.e., 9.7 times the surface speed of the input rolls. The ratch length (distance between the delivery rolls and the input rolls) is 91.4 cm.

The fibers of the ribbon-shaped bundle are picked up from the delivery rolls by an aspirating jet supplied with room temperature air at 2.8 kg./cm.$^2$ gauge air pressure, and a sample of this unconsolidated yarn is collected. In the remainder of the run, the yarn is forwarded from the aspirating jet to an entangling jet mounted 7.6 cm. away and supplied with room temperature air at 3.5 kg./cm.$^2$. The jets are mounted in the same plane as the drafting plane centered on the drafting zone, jets exhausting in a downstream direction. This consolidated yarn is wound up at a speed of 275 mpm. so that there is an overfeed of 3.3% with respect to the windup. Table I summarizes the process conditions employed in preparing the yarns of this and subsequent examples.

The unconsolidated yarn has a cotton count of 29.7, a pin count of 10.8 mm., and is comprised of fibers of 1.9 dpf having the fiber length histogram shown in FIG. 3. It has 2.8 free ends per cm. The unconsolidated yarn is a clean yarn as shown by its nep count of 4, and it is also a strong yarn as shown by its lea product of 3800. Its tenacity is 0.61 gpd. When tested for evenness, it has a CV of 15.0 at 0.076 cm. cut length and 2.58 at 549 cm. cut length. The distribution of fiber lengths is further characterized as follows:

32.8 cm. number average fiber length
43.9 cm. weight average fiber length
12% of fibers no longer than 12.7 cm.
82% of fibers longer than 12.7 cm. and no longer than 76 cm.
6% of fibers longer than 76 cm.

The consolidated yarn has a relatively high level of entanglement as shown by its pin count of 4.83 mm. It has 2.7 free ends per cm. It is a clean yarn of high strength, as shown by its nep count of 10 and its lea product of 5000. Its tenacity is 2.1 gpd. It also has good evenness properties, as shown by its CV of 15.5 at 0.076 cm. cut length and 3.0 at 549 cm. cut length. Table II summarizes the properties and characteristics of the entangled yarn products of this and subsequent examples.

As can be seen from the following three comparative examples outside the scope of the invention, reducing the ratch length used in Example I and replacing the feed filaments with filaments of excessive elongation results in yarns of poorer evenness and quite poor cleaness.

Comparative Example IA

Polyester continuous filaments having a high variable elongation at break are prepared, stretch-broken and entangled in a modification of the process described in Example I. In carrying out this process, six ends of 642 denier, 110 filament, zero-twist tow of continuous filaments of polyethylene terephthalate having an RV of 20.7 and spun at 1372 mpm., having a tenacity of 1.52 gram/denier, an elongation of 355%, and containing 0.08% of the finish described in Example I are consolidated by a guide and passed into the nip of the feed rolls, across a 41.9 cm. hot shoe with a 15.2 cm. contact length at 100°–105° C. to form a ribbon of parallel continuous filaments, and through the nip of the drafting zone input rolls. Additional details of the process employed in preparing the yarns of this example are summarized in Table I. The continuous filaments in the drawn ribbon supplied to the drafting zone have elongations varying from 77 to 139% (averaging 108%), and the shrinkage of the ribbon is 25%.

Figure 4:
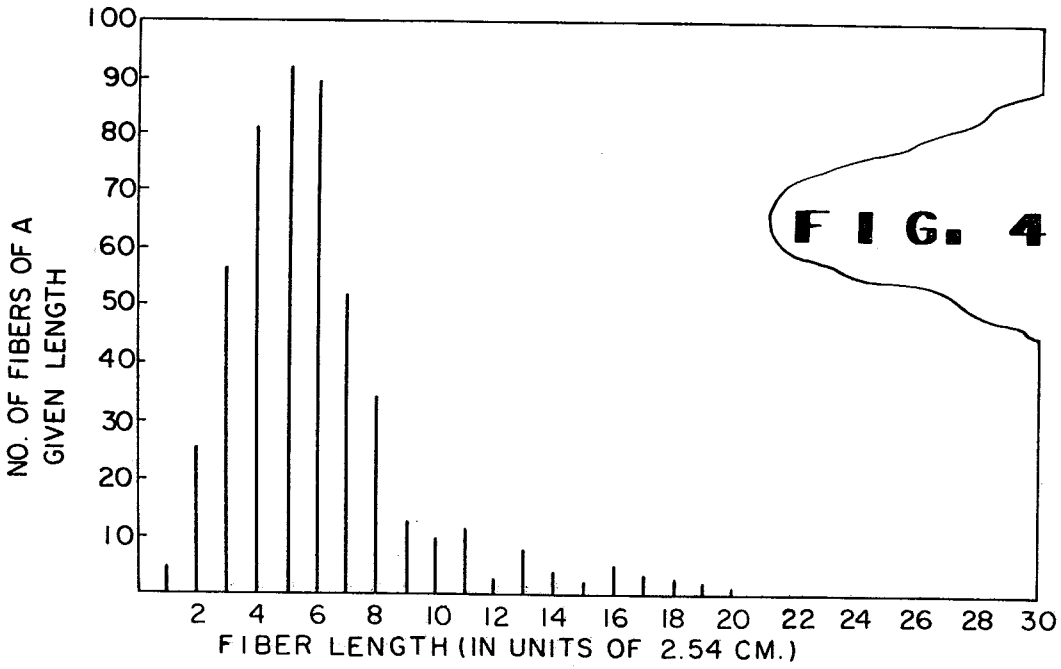

The unconsolidated yarn has a cotton count of 30.4 and is comprised of fibers of 1.65 dpf having the fiber length histogram shown in FIG. 4. The unconsolidated yarn is too weak to test for evenness and to determine a tenacity value at the 76-cm. gauge length in the tensile testing machine. A tenacity value of 0.39 gpd is obtained when a 25.4-cm. gauge length is used.

The consolidated yarn has a relatively high level of entanglement as shown by its pin count of 2.54 mm. Its cleanness is quite poor, as shown by its nep count of 260. Additional details of the products of this comparative example are given in Table II.

Comparative Example IB

Comparative Example IA is repeated, using a longer ratch length in the drafting zone and revised feed zone settings, the details being given in Table I. The continuous filaments in the drawn ribbon supplied to the drafting zone have a high variable elongation at break, the elongations varying from 77 to 141% (averaging 105%), and the shrinkage of the ribbon being 22%.

The unconsolidated yarn has a cotton count of 30 and is comprised of fibers of 2.04 dpf having the fiber length histogram shown in FIG. 5. Its tenacity is only 0.36 gpd.

The cleanness of the consolidated yarn is quite poor, as shown by its nep count of 335, and it also has poor evenness. Product details are given in Table II.

Comparative Example IC

Comparative Example IA is repeated, using a shorter ratch length in the drafting zone and revised feed zone settings with no heating or predrawing, as summarized in Table I. The continuous filaments in the ribbon supplied to the drafting zone have high elongations, ranging from 350 to 440% (averaging 380%), and the shrinkage of the ribbon averages 60%.

The unconsolidated yarn has a cotton count of 30 and is comprised of fibers of 2.00 dpf having the fiber length histogram shown in FIG. 6. The unconsolidated yarn is too weak to test for evenness and to determine a tenacity value at the 76-cm. gauge length in the tensile testing machine. A tenacity value of 0.35 gpd is obtained when a 51-cm. gauge length is used.

The cleanness of the consolidated yarn is quite poor, as shown by its nep count of 250, and its evenness properties are also quite poor. Product details are given in Table II.

EXAMPLE II

An entangled yarn of low dpf polyester fibers is produced by repeating the general procedure of Example I, using as the feed six ends of 330 denier, 150 filament, zero-twist tow of continuous filaments of poly(ethylene terephthalate/5-sulfoisophthalate sodium salt) 98/2) having an RV of 10.8 and spun at 3109 mpm, having a tenacity of 1.48 gram/denier, an elongation of 143%, and containing 0.11% of the finish used in Example I. A hot shoe having a contact length of 15.2 cm. is used in the feed zone as in Example IA. Process details are given in Table I. The continuous filaments in the drawn ribbon supplied to the drafting zone have elongations varying from 31 to 55% (averaging 44%) and the shrinkage of the ribbon is 13.4%. The unconsolidated yarn has a cotton count of 59.2 and is comprised of fibers of 1.4 dpf.

As shown in Table II, both the consolidated and unconsolidated yarn products of this example are exceptionally clean yarns of good evenness.

EXAMPLE III

An entangled yarn of high dpf polyester fibers is produced by repeating the general procedure of Example I, using as the feed 12 ends of 360 denier, 50 filaments, zero-twist tow of continuous filaments of poly(ethylene terephthalate/5-sulfoisophthalate sodium salt) (98/2) having an RV of 10.3 and spun at 3109 mpm, having a tenacity of 1.34 gram/denier, an elongation of 155%, and containing 0.11% of the finish used in Example I. Process details are given in Table I. The continuous filaments in the drawn ribbon supplied to the drafting zone have elongations varying from 32 to 48% (averaging 39%) and the shrinkage of the ribbon is 77.0%.

The unconsolidated yarn has a cotton count of 20.3 and is comprised of fibers of 3.6 dpf. Product details are given in Table II. As shown in the table, the yarn products are clean yarns of good evenness.

EXAMPLE IV

A low-shrinkage entangled yarn of polyester fibers is produced by repeating the general procedure of Example I, using as the feed seven ends of 564 denier, 150 filament, zero-twist tow of continuous filaments of poly(ethylene terephthalate/5-sulfoisophthalate sodium salt) (98/2) having an RV of 10.6 and spun at 3109 mpm, having a tenacity of 1.49 gram/denier, an elongation of 160%, and containing 0.155% of the finish used in Example I. A hot shoe having a contact length of 15.2 cm. is used in the feed zone as in Example IA. Process details are given in Table I. The continuous filaments in the drawn ribbon supplied to the drafting zone have elongations varying from 39 to 57% (averaging 48%) and the shrinkage of the ribbon is 5.38%.

The unconsolidated yarn has a cotton count of 29.0 and is comprised of fibers of 2.1 dpf. Product details are given in Table II. As shown in the table, the yarn products are clean yarns of good evenness. The unconsolidated yarn has a shrinkage of only 13%, and the consolidated yarn a shrinkage of only 10%.

EXAMPLE V

A mixed shrinkage entangled yarn of polyester fibers is produced by repeating the general procedure of Example I, using as the feed eight ends of 503 denier, 150 filament, zero-twist tow of continuous filaments of poly(ethylene terephthalate/5-sulfoisophthalate sodium salt) (98/2) having an RV of 10.7 and spun at 3109 mpm, having a tenacity of 1.53 gram/denier, an elongation of 153%, and containing 0.167% of the finish used in Example I. A hot shoe is used in the feed zone as in Example IA; however, the contact length is only 7.62 cm. in this instance so that the fibers in the entangled yarn product will have varying shrinkages. Process details are given in Table I. The continous filaments in the drawn ribbon supplied to the drafting zone have elongations varying from 45 to 75% (averaging 64%), and the shrinkage of the ribbon is 7.62%.

The unconsolidated yarn has a cotton count of 29.8 and is comprised of fibers of 1.9 dpf. Product details are given in Table II. As shown in the table, the yarn products are clean yarns of good evenness. The unconsolidated yarn has a shrinkage of 24% and the consolidated yarn a shrinkage of 21%; both yarns are relatively bulky when boiled off owing to the mixed shrinkages of the fibers in the yarns.

EXAMPLE VI

The general procedure of Example I is repeated, using as the feed eight ends of 530 denier, 150 filament, zero-twist tow of continuous filaments of poly(ethylene terephthalate/5-sulfoisophthalate sodium salt) (98/2) having an RV of 13.2 and spun at 2743 mpm, having a tenacity of 1.51 gram/denier, an elongation of 153%, and containing 0.071% of the finish used in Example I. Process details are given in Table I. The continuous filaments in the drawn ribbon supplied to the drafting zone have elongations varying from 35 to 60% (averaging 47.5%), and the shrinkage of the ribbon is 80.1%.

The unconsolidated yarn has a cotton count of 30.4 and is comprised of fibers of 1.80 dpf. Product details are given in Table II. As shown in the table, the yarn products are clean yarns of good evenness.

EXAMPLE VII

A single end of 2200 denier, 450 filament, zero-twist tow of continuous filaments of polyethylene terephthalate having an RV of 20.5 and spun at 2286 mpm, having a tenacity of 2.27 gram/denier, an elongation of 248%, and containing 0.163% of the finish used in Example I is employed as the feed to produce an entangled yarn by the general procedure of Example I. Process details are given in Table I. A hot shoe is used in the feed zone as in Example IA; however, the contact length is 25.4 cm. in this instance. The continuous filaments in the drawn ribbon supplied to the drafting zone have elongations varying from 52 to 67% (averaging 59%), and the shrinkage of the ribbon is 50.8%.

The unconsolidated yarn has a cotton count of 24.8 and is comprised of fibers of 2.00 dpf. Product details are given in Table II. As shown in the table, both the consolidated and unconsolidated yarn products of this example are characterized by exceptional cleanness and evenness.

EXAMPLE VIII

An entangled yarn of polyester fibers is produced at high speed by repeating the general procedure of Example I, using as the feed eight ends of 564 denier, 150 filament, zero-twist tow of continuous filaments of poly(ethylene terephthalate/5-sulfoisophthalate sodium salt) (98/2) having an RV of 10.6 and spun at 3108 mpm, having a tenacity of 1.46 gram/denier, an elongation of 165%, and containing 0.116% of a finish comprising a mixture of a high viscosity polyalkylene oxide and the amine salt of a phosphate acid ester. A hot shoe is used in the feed zone as in Example IA, however, the contact length is 91.4 cm. in this instance. Process details are given in Table I. The continuous filaments in the drawn ribbon supplied to the drafting zone have elongations varying from 45 to 62% (averaging 53%) and the shrinkage of the ribbon is 15.9%.

The unconsolidated yarn has a cotton count of 22.8 and is comprised of fibers of 2.03 dpf. Product details are given in Table II. As shown in the table, both the consolidated and unconsolidated yarn products of this example are clean yarns of good evenness.

EXAMPLE IX

An entangled yarn of nylon fibers is produced by repeating the general procedure of Example I, using as the feed seven ends of 380 denier, 129 filament, zero-twist tow of polyhexamethylene adipamide continuous filaments having a tenacity of 2.32 gram/denier, an elongation of 245%, and containing 5% of a finish comprising a copolymer of terephthalic acid, ethylene glycol, and polyethylene glycol. Process details are given in Table I. The continuous filaments in the drawn ribbon supplied to the drafting zone have elongations varying from 19 to 62% (averaging 53%), and the shrinkage of the ribbon is 7.80%.

The unconsolidated yarn has a cotton count of 29.8, and is comprised of fibers of 1.22 dpf. Product details are given in Table II. As shown in the table, the yarn products are clean yarns of good evenness.

EXAMPLE X

An entangled yarn of a blend of polyester fibers and nylon fibers is produced by repeating the general procedure of Example I, using as the feed four ends of 475 denier, 110 filament, zero-twist tow of continuous filaments of polyethylene terephthalate having an RV of 20.7 and spun at 2469 mpm, having a tenacity of 1.92 gram/denier, an elongation of 216%, and containing 0.07% of the finish used in Example I and four ends of 380 denier, 129 filament, zero-twist tow of polyhexamethylene adipamide continuous filaments having a tenacity of 2.32 gram/denier, an elongation of 245%, and containing 5% of the finish used in Example IX. Process details are given in Table I. The continuous filaments in the drawn ribbon supplied to the drafting zone have elongations varying from 29 to 70% (averaging 56%), and the shrinkage of the ribbon is 21.2%.

The unconsolidated yarn has a cotton count of 24.0 and is comprised of fibers of 1.3 dpf. Product details are given in Table II. As shown in the table, both the consolidated and unconsolidated yarn products of this example are clean yarns of good evenness.

EXAMPLE XI

A single end of finish-free 2200 denier, 2000 filament, zero-twist tow of rayon continuous filaments having a tenacity of 4.9 gram/denier and an elongation of 19% is employed as the feed to produce an entangled yarn by the general procedure of Example I, passing the tow over an idler feed roll in this instance with no draw imposed in the feed zone. The continuous filaments in the ribbon supplied to the drafting zone have elongations varying from 14 to 22% (averaging 18.8%), and the shrinkage of the ribbon is 1.06%.

The unconsolidated yarn has a cotton count of 29.8 and is comprised of 1.14 dpf. Product details are given in Table II. As shown in the table, the yarn products are clean yarns of good evenness.

EXAMPLE XII

Aramid continuous filaments having low elongation at break are prepared, stretch-broken to form a ribbon of parallel discontinuous fibers, and entangled by the general procedure of Example I, using a feed comprising a single end of finish-free 1500 denier, 1000 filament, zero-twist tow of poly-p-phenylene terephthalamide continuous filaments having a tenacity of 28.8 gram/denier and an elongation of 5%. In this instance, the tow is passed through parallelizing bars between guide 4 and roll 6 of FIG. 1. Process details are given in Table I. The continuous filaments of the drawn ribbon supplied to the drafting zone have elongations varying from 4 to 5.6% (averaging 4.8%), and the shrinkage of the ribbon is 0%.

The unconsolidated yarn has a cotton count of 53.5 and is comprised of fibers of 1.45 dpf. Product details are given in Table II. As shown in the table, both the consolidated and unconsolidated products of this example are clean yarns, and the consolidated yarn is characterized by very high strength.

EXAMPLE XIII

A single end of 3300 denier, 1825 filament, zero-twist tow of filaments of acrylonitrile/methyl acrylate/sodium styrenesulfonate (91.5/8/0.5) containing 0.5% $TiO_2$ and having a tenacity of 2.8 gram/denier, an elongation of 22%, and containing 1% of the finish used in Example I is employed as the feed to produce an entangled yarn by the general procedure of Example I, passing the tow over an idler feed roll in this instance with no draw imposed in the feed zone. Process details are given in Table I. The continuous filaments in the ribbon supplied to the drafting zone have elongations varying from 13 to 25% (averaging 22%), and the shrinkage of the ribbon is 9.45%.

The unconsolidated yarn has a cotton count of 23.7 and is comprised of fibers of 1.47 dpf. Product details are given in Table II. As shown in the table, this unconsolidated yarn product is characterized by good cleanness and evenness.

The yarns of Examples I–XIII are somewhat more bulky than typical ring-spun yarns of the same polymer composition, denier per filament, and cotton count. Although these yarns have a relatively open structure, the fibers comprising the yarns of the examples are substantially free or crunodal loops.

TABLE I.

PROCESS CONDITIONS EMPLOYED IN PREPARING ENTANGLED STAPLE YARNS

| | | Feed Zone Settings | | | | | Drafting Zone Settings | | | Jet Pressures | | | |
|---|---|---|---|---|---|---|---|---|---|---|---|---|---|
| Example No. | Polymer | Input Roll Speed mpm. | Feed Zone Length cm. | Draw Ratio | Hot Shoe Temp. ° C. | Av. Feed Fila. Elong. | Ratch Length cm. | Draft Ratio | Delivery Roll Speed mpm. | Aspirating Jet kg./cm.$^2$ | Entangling Jet kg./cm.$^2$ | Windup Speed mpm. | Over-Feed |
| Ex. I | Polyester | 29.3 | 25 | 2.6X | — | 40% | 91 | 9.7X | 284 | 2.8 | 3.5 | 275 | 3.3% |
| Comp. IA* | Polyester | 19.2 | 76 | 2.15 | 100–5 | 108 | 30 | 10.4 | 200 | 4.2 | 3.5 | 194 | 3.4 |
| Comp. IB* | Polyester | 19.2 | 61 | 2.10 | 100–5 | 105 | 46 | 10.4 | 200 | 4.2 | 3.5 | 193 | 3.3 |
| Comp. IC* | Polyester | 9.1 | 76 | 1.0 | — | 380 | 17 | 21.9 | 200 | 4.2 | 3.5 | 193 | 3.6 |
| Ex. II | Polyester | 16.3 | 29 | 1.6 | 105 | 44 | 91 | 14.6 | 237 | 3.5 | 2.1 | 228 | 4.1 |
| Ex. III | Polyester | 21.7 | 42 | 2.0 | — | 39 | 76 | 8.6 | 186 | 3.5 | 3.5 | 182 | 1.8 |
| Ex. IV | Polyester | 16.6 | 29 | 1.6 | 108 | 48 | 91 | 14.2 | 237 | 3.5 | 2.1 | 227 | 4.4 |
| Ex. V | Polyester | 16.3 | 29 | 1.64 | 103 | 64 | 91 | 14.6 | 238 | 3.5 | 2.1 | 228 | 4.4 |
| Ex. VI | Polyester | 14.7 | 17 | 2.0X | — | 48% | 102 | 12.8X | 189 | 3.5 | 1.4 | 182 | 3.5% |
| Ex. VII | Polyester | 37.2 | 18 | 2.07 | 80 | 59 | 91 | 5.04 | 187 | 2.1 | 2.1 | 183 | 2.5 |
| Ex. VIII | Polyester | 51.2 | 191 | 1.6 | 105 | 53 | 89 | 12.2 | 625 | 2.8 | 2.8 | 624 | 1.8 |
| Ex. IX | Nylon | 29.7 | 15 | 2.41 | — | 53 | 91 | 6.7 | 199 | 3.5 | 2.8 | 188 | 5.7 |
| Ex. X | Nylon/ Polyester | 26.7 | 15 | 2.5 | — | 56 | 91 | 7.3 | 194 | 3.5 | 1.4 | 188 | 3.1 |
| Ex. XI | Rayon | 15.0 | — | — | — | 19 | 91 | 13.1 | 196 | 1.8 | 1.4 | 194 | 1.3 |
| Ex. XII | Aramid | 16.0 | 15 | 1.24 | — | 5 | 91 | 11.8 | 190 | 3.5 | 3.5 | 188 | 0.8 |
| Ex. XIII | Acrylic | 4.1 | — | — | — | 22 | 91 | 16.4 | 67.5 | 3.5 | — | 65.2 | 3.5 |

*Comparative Examples

TABLE II.

PROPERTIES AND CHARACTERISTICS OF ENTANGLED STAPLE YARN PRODUCTS

| | Fiber Length Distribution in Yarn | | | | | | | | | | |
|---|---|---|---|---|---|---|---|---|---|---|---|
| Example No. | No. Av. cm. | Wt. Av. cm. | ≦12.7 cm. % | >76 cm. % | Consolidated or Unconsolidated | Pin Count mm. | Free Ends/cm. | CV 0.076/549 | Yarn Tenacity gpd | Lea Prod. | Neps |
| Ex. I | 32.8 | 43.9 | 12 | 6 | Consol. | 4.8 | 2.7 | 15.5/3.0 | 2.1 | 5000 | 10 |
| | | | | | Unconsol. | 10.8 | 2.8 | 15.0/2.58 | 0.61 | 3800 | 4 |
| Comp. IA* | 13.7 | 18.3 | 51.8 | None | Consol. | 2.5 | 4.9 | 19.1/2.8 | 1.2 | 3300 | 260 |
| | | | | | Unconsol. | 14.2 | 4.7 | — | 0.39 | — | — |
| Comp. IB* | 36.3 | 45.7 | 6.0 | None | Consol. | 3.8 | 5.2 | 24.3/3.8 | 1.65 | 3000 | 334 |
| | | | | | Unconsol. | 10.5 | 2.5 | — | 0.36 | 2300 | — |
| Comp. IC* | 36.8 | 39.4 | 1.7 | None | Consol. | 2.6 | 3.0 | >30/3.9 | 1.86 | 3400 | 250 |
| | | | | | Unconsol. | 11.1 | 2.9 | — | 0.35 | — | — |
| Ex. II | 31.2 | 40.4 | 9.6 | 2.0 | Consol. | 6.9 | 2.6 | 16.5/2.92 | 1.44 | 2985 | 2 |
| | | | | | Unconsol. | 10.8 | 2.4 | 16.7/2.75 | 1.12 | 2605 | 2 |
| Ex. III | 28.7 | 40.4 | 12.6 | 4.4 | Consol. | 9.0 | 2.0 | 17.1/3.30 | 1.3 | 2800 | 30 |
| | | | | | Unconsol. | 13.4 | 2.6 | 16.5/3.45 | 0.54 | 2400 | 24 |
| Ex. IV | 36.3 | 45.5 | 5.8 | 3.8 | Consol. | 8.8 | 1.8 | 15.2/3.14 | 1.35 | 2900 | 34 |
| | | | | | Unconsol. | 11.1 | 2.2 | 14.6/2.95 | 1.02 | 2500 | 4 |
| Ex. V | 26.7 | 36.1 | 12.2 | 2.4 | Consol. | 8.5 | 3.4 | 14.2/3.28 | 1.38 | 2860 | 10 |
| | | | | | Unconsol. | 11.3 | 3.0 | 15.1/3.35 | 0.55 | 2200 | 5 |
| Ex. VI | 33.0 | 43.7 | 8.6 | 2.4 | Consol. | 7.4 | 2.6 | 15.7/3.35 | 0.92 | 2950 | 14 |
| | | | | | Unconsol. | 6.9 | 3.2 | 16.3/3.25 | 0.62 | 2950 | 1 |
| Ex. VII | 37.6 | 51.3 | 8.0 | 5.2 | Consol. | 11.2 | 2.0 | 12.4/2.65 | 1.33 | 4687 | 6 |
| | | | | | Unconsol. | 17.9 | 2.5 | 14.7/2.47 | 0.81 | 3000 | 2 |
| Ex. VIII | 38.9 | 55.9 | 7.8 | 12.0 | Consol. | 16.8 | 3.5 | 13.4/2.87 | 0.93 | 2340 | 2 |
| | | | | | Unconsol. | 23.1 | 2.8 | 15.0/3.25 | 0.79 | 1940 | 32 |
| Ex. IX | 44.7 | 66.0 | 12 | 18.6 | Consol. | 9.0 | 2.0 | 13.8/2.40 | 2.26 | 5400 | 9 |
| | | | | | Unconsol. | 12.9 | 2.1 | 13.0/2.47 | 1.48 | 4800 | 2 |
| Ex. X | 40.4 | 61.7 | 11.8 | 13.2 | Consol. | 9.6 | 3.5 | 14.8/2.95 | 1.18 | 3750 | 54 |
| | | | | | Unconsol. | 13.5 | 2.7 | 15.3/2.95 | 0.98 | 3360 | 45 |
| Ex. XI | 20.8 | 35.0 | 41.8 | 1.6 | Consol. | 11.2 | 6.3 | 18.9/6.15 | 1.85 | 3740 | 46 |
| | | | | | Unconsol. | 43.5 | 6.7 | 17.6/4.95 | 1.01 | 2025 | 11 |
| Ex. XII | 29.2 | 52.1 | 38.4 | 7.2 | Consol. | 4.1 | 1.7 | 21.7/5.31 | 7.1 | 14580 | 22 |
| | | | | | Unconsol. | 24.3 | — | 20.6/5.22 | 0.71 | 2670 | 16 |
| Ex. XIII | 31.5 | 49.5 | 12.4 | 19.5 | Unconsol. | 4.6 | 5.2 | 20.0/3.7 | 1.54 | 2400 | 31 |

*Comparative Examples

The relationship of the yarns of this invention to conventional ring-spun and open-end-spun yarns will be better understood by reference to FIG. 7, which is a graph of values for pin count and number of free ends per centimeter for various yarns. The reported values for Examples I–XIII (excluding Comparative Example yarns) are plotted thereon as "Yarns of This Invention", together with the corresponding values for typical ring-spun and open-end-spun yarns comprised of polyester fibers having an average fiber length of about 3–8 cm. (representative of commercially available polyester spun yarns). In FIG. 7, the pin count values shown for both the ring-spun and open-end-spun yarns (which contain bundle twist) and for the yarns of this invention (which do not contain bundle twist) are values measured on yarns not subjected to an untwisting operation prior to measurement. It will be observed that the points representing ring-spun and open-end-spun yarns are all located close to the vertical axis, since such yarns have a relatively tight, twisted structure (very low pin count). Because of the typically low average fiber length of such yarns, they tend to have relatively high values for number of free ends per cm. The yarns of this invention are more open (higher pin count) and have relatively low values for free ends per cm.

The fibers comprising the yarns of this invention have a minimum average fiber length of 18 cm. Typical yarns of the invention have an average of 90 to 110 fibers per cross section. For yarns having an average of 90 fibers per cross section and an average fiber length of 18 cm., it is readily calculated that the maximum number of free ends per cm. would be 10. (Since each fiber has two ends, the number of free ends per cm. is calculated as $2 \times 1/18 \times 90 = 10$.) The dotted horizontal line "F" on the graph corresponds to this value. Since many of the fiber ends are buried within the yarn, the observed number of free ends is much lower than this limit, so that all of the points representing yarns of the invention fall far below line "F". The lower limit of 3 for the pin count of the yarns of this invention is shown on the graph as dotted vertical line "P".

Because they have a more open structure than ring-spun and open-end-spun yarns, the yarns of this invention are spun-like in character despite their low level of free ends per cm. They may be twisted, sized, or otherwise treated or handled in the same manner as conventional spun yarns. When judged by the standards of conventional ring-spun yarns, the yarns of this invention are bulkier and have excellent cleanness and strength. Fabrics woven from yarns of the invention are correspondingly bulkier and provide better cover than fabrics of the same weight made from conventional ring-spun yarns.

We claim:

1. An entangled yarn of closely adjacent, synthetic organic fibers which are randomly intermingled along the length of the yarn to maintain the unity of the yarn by frictional constraint between the fibers; the yarn having an entanglement pin count of 3 to 50 millimeters and the fibers having a number average fiber length of 18 to 60 centimeters with a distribution of fiber lengths such that at least 5 percent of the fibers are no longer than 12.7 centimeters, 50 percent to 93.5 percent of the fibers are longer than 12.7 cm. and no longer than 76 centimeters, and at least 1.5 percent of the fibers are longer than 76 centimeters.

2. An entangled yarn as defined in claim 1 which is a consolidated yarn having an entanglement pin count of 3 to 25 millimeters.

3. An entangled yarn as defined in claim 2 wherein the yarn tenacity in grams per denier is at least 45 percent of the fiber tenacity.

4. An entangled yarn as defined in claim 1 wherein the yarn is composed of polyethylene terephthalate fibers.

* * * * *